United States Patent [19]

Masovich et al.

[11] Patent Number: 4,861,111

[45] Date of Patent: Aug. 29, 1989

[54] MINING CUTTER-LOADER FOR WINNING MINERALS

[76] Inventors: Felix Z. Masovich, ulitsa Chaikovskogo, 15, kv. 59; Vladimir N. Khorin, Fakultetsky pereulok, 3, kv. 206; Vladimir V. Starichnev, ulitsa Novolesnaya, 18, korpus 1, kv. 128; Vladimir V. Turkin, ulitsa Smolenskaya, 7, kv. 181, all of Moscow, U.S.S.R.

[21] Appl. No.: 643,964

[22] PCT Filed: May 27, 1983

[86] PCT No.: PCT/SU83/00013

§ 371 Date: Aug. 13, 1984

§ 102(e) Date: Aug. 13, 1984

[87] PCT Pub. No.: WO84/02737

PCT Pub. Date: Jul. 19, 1984

[30] Foreign Application Priority Data

Jan. 11, 1983 [SU] U.S.S.R. ..... 3528702

[51] Int. Cl.[4] ..... E21C 27/02

[52] U.S. Cl. ..... 299/43

[58] Field of Search ..... 299/42, 43, 45

[56] References Cited

U.S. PATENT DOCUMENTS

| | | | |
|---|---|---|---|
| 4,372,618 | 2/1983 | Pearey | 299/43 X |
| 4,435,018 | 3/1984 | Parrott | 299/43 |
| 4,508,391 | 4/1985 | Spektor et al. | 299/43 |

FOREIGN PATENT DOCUMENTS

| | | |
|---|---|---|
| 1521006 | 8/1978 | United Kingdom . |
| 2081778 | 2/1982 | United Kingdom . |

*Primary Examiner*—Stephen J. Novosad

*Attorney, Agent, or Firm*—Lilling & Greenspan

[57] ABSTRACT

The mining cutter-loader for winning minerals with a chainless feed system comprises a housing and a gantry pivotally connected with the housing, overlying the conveyor. The gantry carries propulsion mounted on the conveyer. The propulsion gears and the guiding rack are mounted in inclination relative to the axis of the housing, transvers with respect to the direction of the motion of the cutter-loader. Hydraulic cylinders are mounted between the housing and the gantry for fixing the housing relative to the gantry, having their one ends pivotally connected to the housing and their opposite ends pivotally connected to the gantry.

1 Claim, 3 Drawing Sheets

MINING CUTTER-LOADER FOR WINNING MINERALS

FIELD OF THE INVENTION

The present invention relates to the mining industry, and more particularly it relates to a mineral-winning mining machine, e.g. a mining cutter-loader.

BACKGROUND OF THE INVENTION

There is known a mineral-winning mining cutter-loader (see, for example, UK Application No. 2081778A, Int. Cl.[2] E21C 27/32) with a chainless feed system, comprising a housing and a gantry.

The housing is arranged at the working-face side of the conveyer and has its longitudinal axis extending along the conveyer. Accommodated along the longitudinal axis of the housing, in the cantilever fashion at the ends thereof are work-performing members for breaking the mineral and loading it onto the conveyer.

The housing accommodates therein the drive mechanisms of the work-performing members. Overlying the conveyer is a gantry pivotally connected with the housing.

The gantry accommodates the feed mechanism of the cutter-loader, including gears with horizontal axes of rotation, arranged at the working-face side of the conveyer, and a drive with reduction gearing to actuate the gears.

A guiding rack is mounted on the conveyer at the working-face side thereof, intended for meshing interaction with the gears as the cutter-loader is displaced along the working-face.

In this structure of the prior art the housing is mounted for vertical adjustment relative to the gantry.

The housing is provided with hydraulic supports bearing upon the floor of the seam, which are in the form of hydraulic cylinders. Arranged between the housing and the gantry are vertical hydraulic cylinders intended to perform vertical adjustment of the housing relative to the gantry as the thickness of the mineral seam varies.

The provision in the structure of the prior art for vertical adjustment of the housing alone relative to the gantry is insufficient for operation in thin seams, since under these conditions more often than not there arises the necessity of vertical adjustment, first and foremost, of the gantry itself. This adjustment could be required when, under the thin seam conditions, there arises the necessity of passing under the gantry oversize pieces of the mineral, or else of passing the gantry itself under a sagging beam of the roof support, and so on.

In the structure of the prior art, the vertical position of the gantry relative to the conveyer is practically inadjustable to avoid interference with the meshing of the gears of the feed mechanism with the rack attached to the conveyer.

The mineral-winning mining cutter-loader of the prior art is impractical for operation in thin seams, particularly those in the range of thicknesses from 0.65 to 1 meter, because the above described arrangement of the propulsion gears results in the gantry being of a relatively great height.

SUMMARY OF THE INVENTION

The present invention has for its aim the creation of a mineral-winning mining cutter-loader with a chainless feed system, wherein the propulsion gears and the guiding rack should be so arranged as to provide for reducing the height of the gantry and for adjusting the vertical position of the gantry in operation.

This aim is attained in a mineral-winning mining cutter-loader with a chainless feed system, comprising a housing arranged at the working-face side of the conveyer and a gantry pivotally connected with the housing, overlying the conveyer and carrying propulsion gears interacting with a guiding rack mounted on the conveyer, in which cutter-loader, in accordance with the invention, the propulsion gears and the guiding rack are arranged at an inclination relative to the axis of the housing, transverse with respect to the direction of the motion of the cutter-loader; hydraulic cylinders being mounted between the housing and a gantry for fixing the housing relative to the gantry, having their one ends pivotally connected to the housing and their opposite ends pivotally connected to the gantry.

Because of this structure, the herein disclosed mining cutter-loader has a relatively small height, both the housing and the gantry having their respective heights adjustable.

It is expedient that the guiding rack be pivotally accommodated at the goaf side of the conveyer, for pivoting jointly with the gantry.

With the guiding rack being accommodated at the goaf side of the conveyer, conditions are created for unobstructed loading of the broken mineral onto the conveyer, whereby the rack pivots with the gantry ensuring the continuance of the engagement of the propulsion gears with the guiding rack as the height of either the housing or the gantry is being adjusted.

Therefore, a mining cutter-loader constructed in accordance with the present invention can be effectively and efficiently employed for mining thin seams, particularly those of varying thickness, by adjusting the height of the cutter-loader. The adjustability of the height of the gantry enhances the conditions of conveying the mineral, particularly when large lumps or pieces are contained in its stream, and also allows for unobstructed passage of the gantry itself under the beams of the roof supports.

The herein disclosed mining cutter-loader is operable for mineral-winning in thin, gently-sloping and inclined seams in association with a chainless feed system, ensuring working safety in this environment.

A mining cutter-loader in accordance with the present invention allows for adjusting its height, which is of essential importance for operation in thin seams where control of the height of the cutter-loader can significantly influence the productivity.

These and other advantages of the present invention will be made apparent in the following description of an embodiment thereof with reference being made to the accompanying drawings.

DETAILED DESCRIPTION OF THE INVENTION

Figure 1:
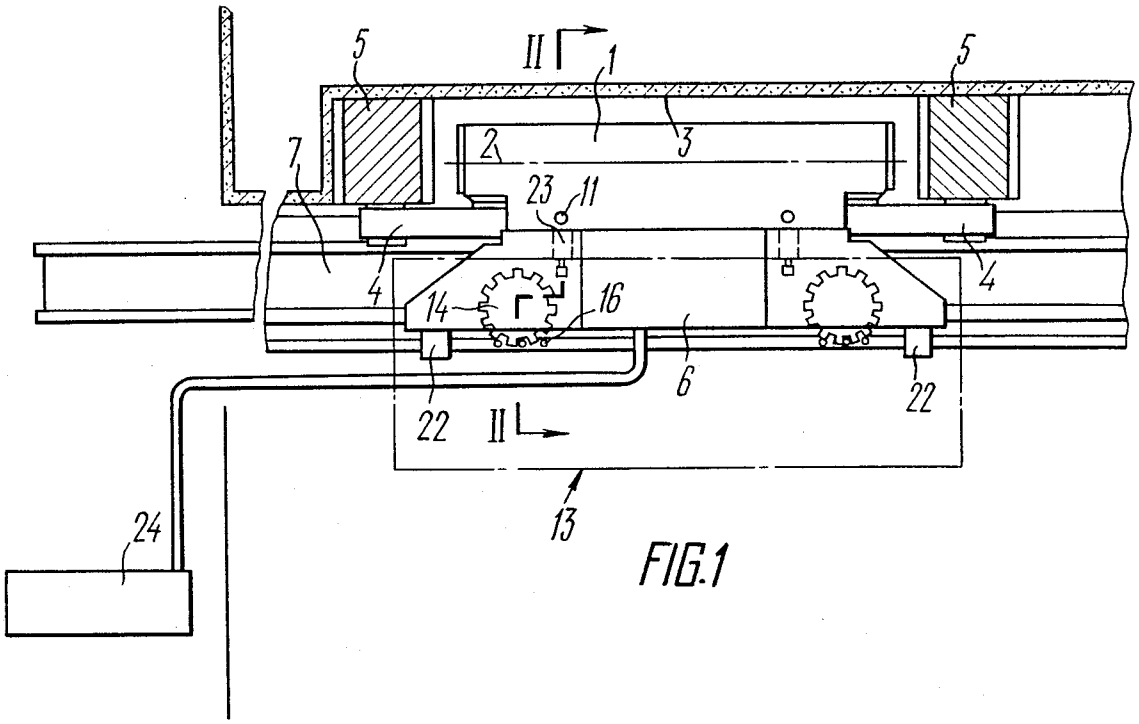
FIG. 1 is a schematic illustration of a mineral-winning mining cutter-loader.

The herein disclosed mining cutter-loader for mineral-winning (to be later referred to as the cutter-loader) has a housing 1 (FIG. 1) whose longitudinal axis 2 extends substantially parallel with the working-face 3. Joined to the respective ends of the housing 1 by arms 4 are work-performing members 5 for breaking and loading the mineral which may be augers of any known per se structures suitable for the purpose. The longitudinal axis of each respective work-performing member 5 extends perpendicularly to the longitudinal axis 2 of the housing.

The housing accommodates therein a drive (not shown) of the work-performing members 5. The cutter-loader further includes a gantry 6 overlying the conveyer 7 and intended for directional propulsion of the cutter-loader longitudinally of the conveyer 7, along the working-face 3.

The gantry 6 is joined to the housing 1 by a pivot 8 (FIG. 2), for which purpose the housing 1 has a lug (not shown) with a bore accommodating the pivot pin or shaft 9 parallel with the longitudinal axis 2 of the housing 1, attached to the gantry 6.

The shaft 9 supports thereon the projecting parts (not shown) of the gantry 6, pivotable relative to the axis of this shaft 9.

The housing 1 bears upon the loading share 10 of the conveyer 7 through hydraulic cylinders 11 arranged vertically in a spaced relationship along the longitudinal axis 2 of the housing 1, as it is illustrated in FIG. 1. Each hydraulic cylinder 11 is accommodated in its specific socket (not shown) in the housing 1. Made fast with the housing of each hydraulic cylinder, in a manner known in the art, is a thrust end journal 12 (FIG. 2) directly bearing upon the loading share 10. The interaction of the thrust end journal 12 with the loading share 10 allows for reducing the feed effort of the cutter-loader in comparison with cutter-loaders bearing directly upon the floor.

The gantry 6 accommodates the chainless propulsion or feed mechanism 13 (FIG. 1) of the cutter-loader, shown in dash-and-dot lines, adapted to displace the cutter-loader longitudinally of the conveyer 7, along the working-face 3. The feed mechanism 13 includes two propulsion gears 14 supported each for rotation about the shaft 15 mounted in the gantry 6. The gantry 6 accommodates therein a drive (not shown) of the gears 14 which may be of any type known in the art. The gears 14 are spaced in the gantry 6 along the longitudinal axis 2, as it can be seen in FIG. 1.

The feed mechanism 13 further includes a guiding rack 16 (FIG. 2) intended for meshing interaction with the gears 14 for moving the cutter-loader along the working-face 3. The guiding rack 16 includes two parallel spaced bars interconnected by cogs 18. The lower bar 17 of the rack 16 is mounted on the side frame (not shown) of the conveyer 7 at the goaf side of the latter, by means of brackets 19.

The bracket 19 incorporates a pivot 20 allowing for joint pivoting of each propulsion gear 14 with the guiding rack 16. The gears 14 and the guiding rack 16 are inclined at an acute angle $\alpha$ relative to the axis 21 of the housing 1, transverse to the direction of the motion of the cutter-loader, i.e. the plane of symmetry of each gear 14 and the guiding rack 16 defines an acute angle $\alpha$ with the axis 21 of the housing 1, opening toward the housing 1.

This feature allows for reducing the height of the gantry 6. The gantry 6 is provided with retaining lugs 22 at the side of its interaction with the guiding rack 16, intended to restrain the cutter-loader against transverse displacement.

The cutter-loader has two hydraulic cylinders 23 for retaining the housing 1 relative to the gantry 6, spaced from each other along the longitudinal axis 2, as it can be seen in FIG. 1. The housing (not specifically indicated) of each hydraulic cylinder 23 is pivotally joined to the housing 1 of the cutter-loader, whereas the piston rod thereof (not indicated, either) is pivotally joined to the gantry 6.

There is a pump 24 (FIG. 1) for feeding the working fluid from a source (not shown) to the hydraulic cylinders 11 and 23.

The gantry supports units 25 (FIG. 2) for controlling the cutter-loader, the access to which is facilitated by the inclined arrangement of the propulsion gears 14.

The herein disclosed cutter-loader operates, as follows.

With the corresponding drive being energized, the work-performing members 5 become operable to cut and break the mineral and to load it onto the conveyer 7. The cutter-loader feed mechanism 13 is also energized, and the gantry 6 of the cutter-loader, overlying the conveyer 7, provides for directional motion of the cutter-loader along the working-face 3.

Figure 2:
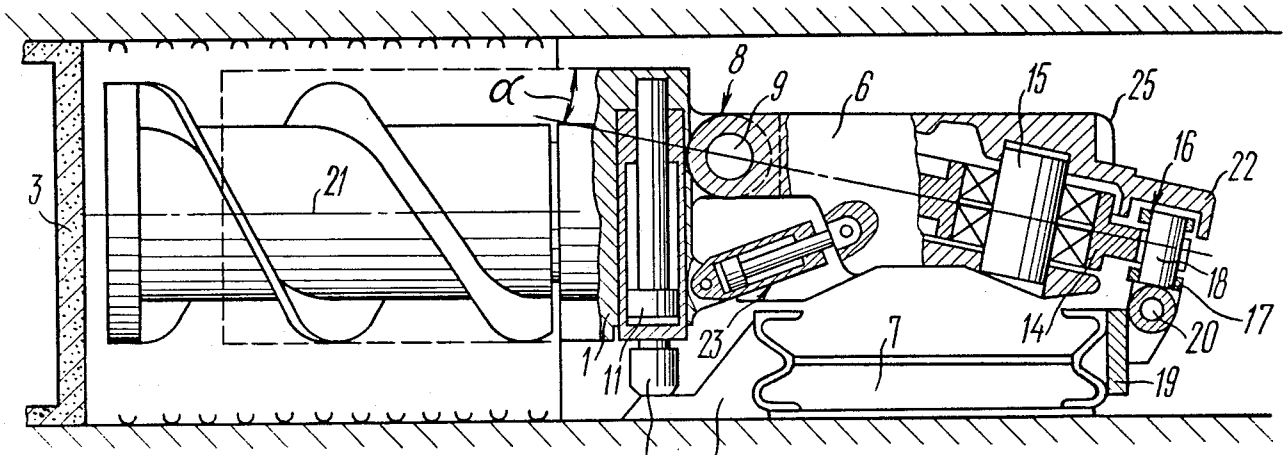
FIG. 2 is a longitudinal view taken along lines II—II of FIG. 1, showing the housing and the gantry of the cutter-loader in their downmost positions.
Figure 3:
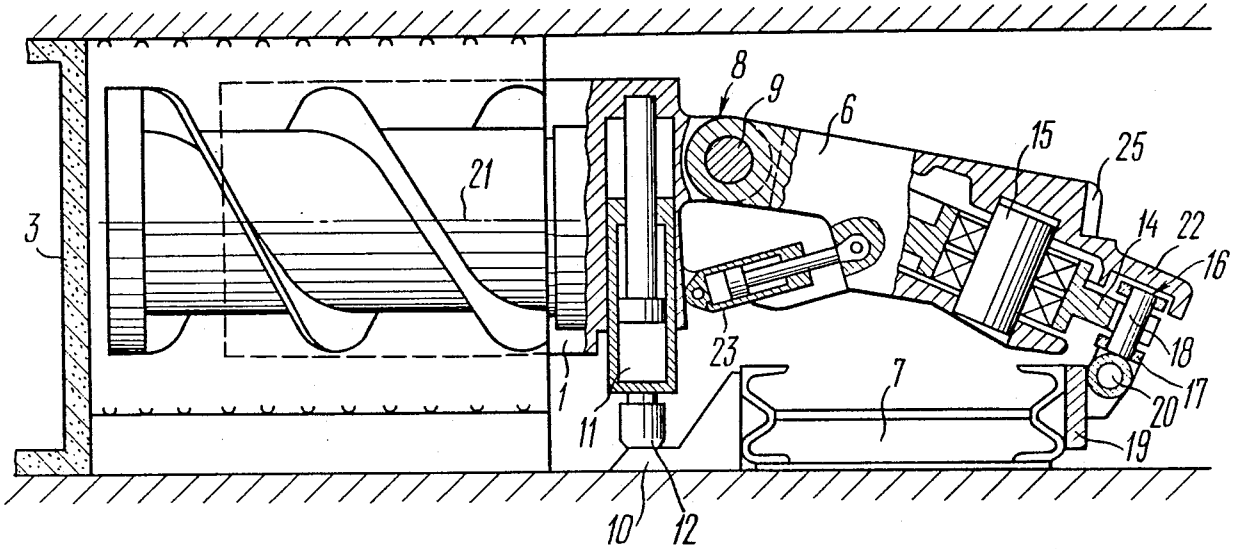
FIG. 3 is a sequential view of FIG. 2, showing the housing and the gantry in their uppermost positions.

When it becomes expedient to adjust the height of the cutter-loader, the working fluid under pressure is fed from the pump 24 to the hydraulic cylinders 11 and 23. Thus, the hydraulic cylinders 11 whose end thrust journals bear upon the loading share 10 of the conveyer 7 displace vertically the housing 1 of the cutter-loader. At the same time, by pivoting about the axis of the pin 9 of the pivot 8, the gantry may acquire any position between the horizontal one (in the lowermost position of the cutter-loader, as shown in FIG. 2) and the inclined position (in the uppermost position, as shown in FIG. 3). The thus obtained position is controlled and retained by the hydraulic cylinders 23 providing rigid connection between the housing 1 and the gantry 6. The motion of the cutter-loader along the working-face 3 longitudinally of the conveyer 7 is effected by the chainless feed mechanism 13. Its propulsion gears 14 are accommodated in the gantry 6 and are rotated from the corresponding drive to interact with the guiding rack 16, thus advancing the cutter-loader.

As the gantry 6 pivots about the axis of the pin 9 of the pivot 8, the gears 14 likewise pivot relative to the shaft 15. This results, owing to the simultaneous interaction of their teeth with the cogs 18, in forced variation of the angle $\alpha$ of inclination of the guiding rack 16, by the latter pivoting about the pivot 20.

Owing to this, the engagement of the gears 14 with the guiding rack 16 remains intact.

There has been manufactured a prototype of the herein disclosed mineral-winning mining cutter-loader which successfully passed a series of thorough and comprehensive tests.

The outcome of the tests has proved that implementation of the present invention helps solve a number of problems:

employment in thin, gently-sloping and inclined seams of cutter-loaders with a chainless feed system, significantly enhances the operation safety at a long wall;

providing the possibility of adjusting the height of the gantry is of essential importance when working in thin seams as the gantry height control substantially influences the productivity.

INDUSTRIAL APPLICABILITY

The present invention can be used to utmost effectiveness for mining thin seams of a mineral, particularly coal.

A mineral-winning cutter-loader constructed in accordance with the present invention can be also used for mining other minerals, e.g. oil shales, potassium salts, etc.

We claim:

1. A mining cutter-loader for thin seam mining having a chainless feed system comprising:

a housing having a working face side substantially parallel with a longitudinal axis of said housing;

at least two work-performing members attached to ends of said housing, a longitudinal axis of said work-performing members extending in a perpendicular direction relative to said longitudinal axis of said housing, said work-performing members breaking and loading minerals onto the cutter-loader;

a drive accommodated within said housing and moving said work-performing members;

a conveyor having a working base side and a goaf side;

first hydraulic cylinders arranged in a vertical direction relative to said longitudinal axis of said housing and bearing said housing upon a loading shear of said conveyer;

a gantry pivotally connected to said housing and overlying said conveyer, said gantry propelling the cutter-loader along said working face side of said conveyer;

a chainless feed system accommodated in said gantry and comprising at least two propulsion gears mounted in said gantry along said longitudinal axis of said housing, a drive moving said gears, and a guiding rack mounted on said goaf side of said conveyer by means of a pivot and interacting with said propulsion gears, saiid propulsion gears pivoting jointly with said guiding rack, said propulsion gears and said guiding rack being inclined in a direction transverse to the motion of the cutter-loader and said gears and said guiding rack defining an acute angle with said longitudinal axis of said work-performing members, said angle having an open side facing said housing;

second hydraulic cylinders having first ends pivotally connected to said housing along a longitudinal axis of said housing and having second ends pivotally connected to said gantry, said second hydraulic cylinders retaining said housing relative to said gantry; and a pump feeding working fluid to said first and second hydraulic cylinder.

* * * * *